US005390749A

United States Patent [19]

Lyon

[11] Patent Number: 5,390,749

[45] Date of Patent: Feb. 21, 1995

[54] APPARATUS FOR POSITIONING A SPLIT RETAINING RING IN A DOWN-HOLE PERCUSSIVE DRILL

[75] Inventor: Leland H. Lyon, Roanoke, Va.

[73] Assignee: Ingersoll-Rand Company, Woodcliff Lake, N.J.

[21] Appl. No.: 191,821

[22] Filed: Jan. 31, 1994

[51] Int. Cl.[6] ..... E21B 4/14

[52] U.S. Cl. ..... 175/296; 175/417

[58] Field of Search ..... 175/414, 415, 417, 296

[56] References Cited

U.S. PATENT DOCUMENTS

| | | | |
|---|---|---|---|
| 1,831,999 | 12/1927 | Bull . | |
| 1,889,806 | 9/1927 | Lamb et al. . | |
| 2,318,878 | 2/1941 | Miller . | |
| 2,855,052 | 10/1954 | Wright et al. . | |
| 3,343,890 | 1/1965 | Homer . | |
| 3,445,144 | 3/1967 | McBrien . | |
| 3,482,889 | 9/1967 | Cochran . | |
| 4,043,409 | 8/1977 | Walter | 175/414 X |
| 4,060,286 | 11/1977 | Boice . | |
| 4,101,179 | 7/1978 | Barron . | |
| 4,378,135 | 3/1983 | Enen, Jr. et al. . | |
| 4,694,911 | 9/1987 | Kennedy | 175/417 X |
| 4,819,746 | 4/1989 | Brown et al. | 175/296 |
| 4,842,082 | 6/1989 | Springer . | |
| 4,844,178 | 7/1989 | Cendre et al. . | |
| 4,848,490 | 7/1989 | Anderson . | |
| 4,854,403 | 8/1989 | Ostertag et al. . | |
| 4,911,255 | 3/1990 | Pearce . | |
| 5,065,827 | 11/1991 | Meyers et al. | 175/414 |
| 5,085,285 | 2/1992 | Elsby et al. | 175/418 X |
| 5,090,500 | 2/1992 | Yousef et al. | 175/414 X |
| 5,154,244 | 10/1992 | Elsby et al. | 175/414 X |
| 5,207,283 | 5/1993 | Lay | 175/296 |
| 5,224,558 | 7/1993 | Lee . | |

*Primary Examiner*—Ramon S. Britts
*Assistant Examiner*—Frank S. Tsay
*Attorney, Agent, or Firm*—John J. Selko

[57] ABSTRACT

An apparatus for a percussive, down-hole drill, for positioning a split retaining ring against an internal surface of a drill casing including a chuck with a tapered top surface, a bit bearing with a tapered bottom surface, and a reversible split retaining ring sandwiched therebetween, the split ring having a tapered top and bottom surface, each tapered surface subtending an angle between 5.7 and 25 degrees, as measured from a perpendicular to a drill longitudinal axis, whereby a portion of any longitudinal load on the split ring is developed into a preselected maximum and minimum amount of radial load, to position the split ring in the casing, without damaging the casing.

10 Claims, 5 Drawing Sheets

APPARATUS FOR POSITIONING A SPLIT RETAINING RING IN A DOWN-HOLE PERCUSSIVE DRILL

BACKGROUND OF THE INVENTION

This invention relates generally to percussive, down-hole drills, and more particularly to an apparatus for positioning a split retaining ring in a casing of a down-hole drill.

Down-hole drills typically use a set of split retaining ring halves to retain the drilling bit within the casing of the drill. These rings are usually flat and split so they can be axially sandwiched and retained between internal drill parts, i.e. the chuck and the bit bearing.

Due to high levels of vibration and shock in the bit end of a down-hole drill, conventional split retaining rings are prone to move radially back and forth within a space provided by the split between the halves. Such movement of rings can cause a number of problems, namely:

1. rubbing of the rings against the bit causing the bit to crack;
2. incomplete contact between the ring halves and the bit contact shoulder;
3. damage to the contact zone on the bit; and
4. high stresses in the ring halves.

The foregoing illustrates limitations known to exist in present down-hole drills. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus for a percussive, down-hole drill, for positioning a split retaining ring against an internal surface of a hollow, cylindrical drill casing, the apparatus including a chuck having a hollow, cylindrical body encircling a longitudinal axis, the body having a longitudinal length extending between a top end and a bottom end, a radial thickness extending between an external surface and an internal surface; the external surface forming a base at the bottom end and a threaded shank at the top end; the internal surface forming a plurality of parallel, longitudinally extending splines, the splines extending to the top end and ending adjacent said bottom end; and means on the top end for developing a longitudinal load exerted thereon into a radial load that exceeds a preselected minimum radial load but does not exceed a preselected maximum radial load.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
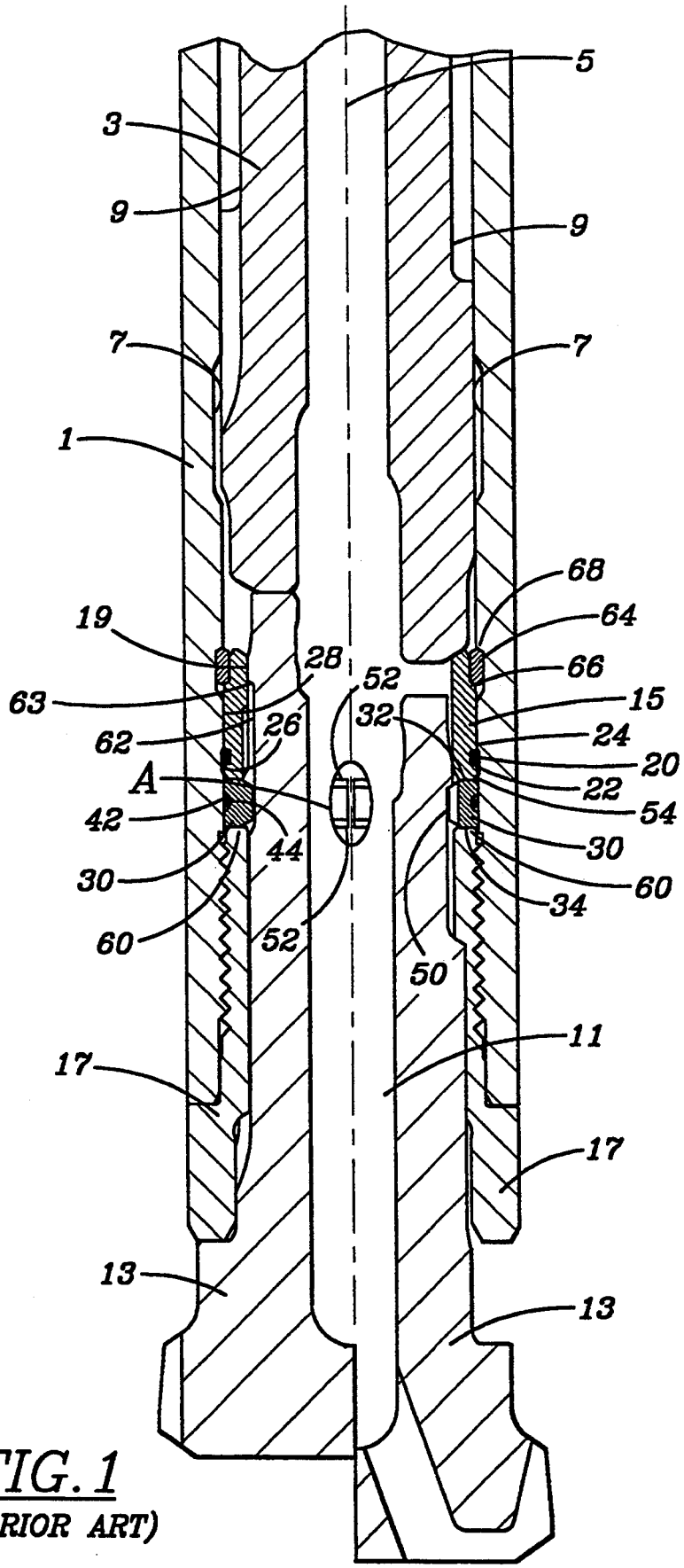
FIG. 1 (PRIOR ART)
FIG. 1 is cross-sectional view of a bit end of a down-hole drill showing the prior art combination for holding a split retaining ring in place, with the bit shown in two different positions.
Figure 2:
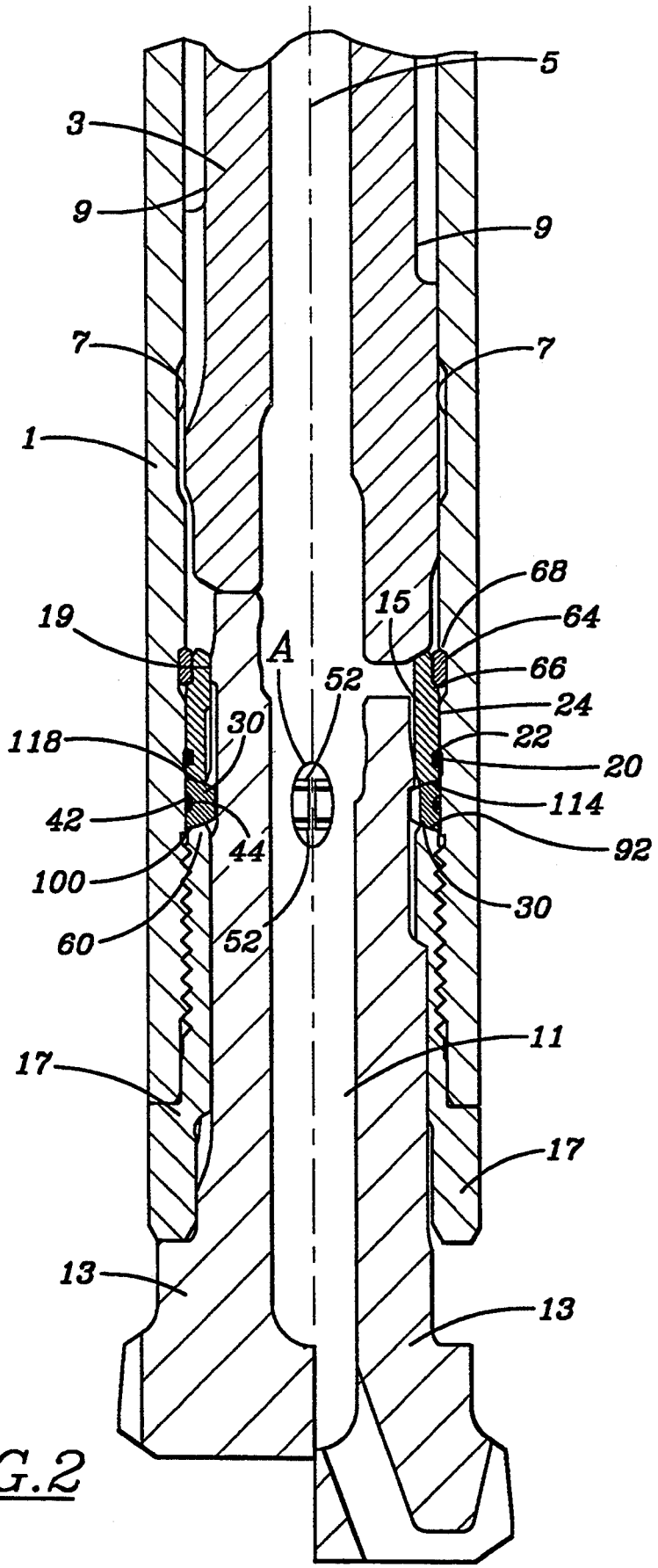
FIG. 2 is a view similar to FIG. 1 showing the apparatus of the invention for holding a split retaining ring in place.

Now referring to FIGS. 1 and 2, a front end of a down-hole drill is shown. Like elements in both drawings are identified with the same number. A hollow, cylindrical casing 1 has a piston 3 reciprocally slidable therein along longitudinal axis 5. As is well known, piston 3 is actuated by means of percussive flow of a fluid, such as compressed air, moving through passageways formed by undercuts 7 and grooves 9 in the internal parts of the drill, as well as passageway 11 through piston 3 and drill bit 13.

Drill bit 13 extends out the end of the casing 1, and is supported and guided by bit bearing 15 and chuck 17, as described hereinafter. Bit bearing 15 contacts land 19 of bit 13 in sliding arrangement. Bit bearing 15 is retained in casing 1 by elastic ring 20 that is positioned in groove 22 in external surface 24 of bit bearing 15 and in undercut 26 in internal surface 28 of casing 1. Chuck 17 is threadably connected to internal surface 28 of casing 1.

Sandwiched between bit bearing 15 and chuck 17 is a split ring 30, consisting of two substantially identical ring halves, each ring half being in the form approximating a semi-circle. As used herein, the term "split ring" includes the two ring halves. In prior art devices, such as is shown in FIG. 1, the split ring 30 has a top surface 32 and a bottom surface 34, both surfaces being perpendicularly oriented to the axis. Split ring 30 has a longitudinally extending body portion 40, having a circumferential groove 42 in the external surface thereof. An elastic member 44 is positioned in groove 42 for holding the ring halves together around bit 13 during insertion of the bit 13 into the drill. The internal surface 50 of ring 30 intersects top surface 32 and bottom surface 34, forming an inner edge 52 that is usually chamfered. FIGS. 1 and 2 show a chamfered edge 52 (in circled portion A) with the amount of chamfer being slightly exaggerated. The bottom end of bit bearing 15 has a shoulder 54 that contacts top surface 32 of split ring 30. Likewise, the top end of chuck 17 has a shoulder 60 that contacts bottom surface 34 of split ring 30. Shoulder 54 and shoulder 60 are both perpendicular to axis 5. The internal surface 50 of ring 30 extends into a circumferential undercut portion 62 in bit 13 in order to retain bit 13 in chuck 17. Shoulder 63 prevents bit 13 from sliding out of chuck 17.

As, is well known, in the assembly of the combination of bit bearing 15, split ring 30 and chuck 17, the split ring 30 is preloaded by the pressure exerted through the chuck 17 and bit bearing 15 by a deflected resilient stop ring 64. Stop ring 64 is positioned between a shoulder 66 on top end of bit bearing 15 and a shoulder 68 formed in a circumferential undercut in casing 1.

In FIGS. 1 and 2, bit 13 is shown in two different positions On the left side of axis 5 bit 13 is shown in the drilling position, and shoulder 63 of bit 13 is out of contact with split ring 30. On the right side of axis 5, bit 13 is shown fully extended, with bit shoulder 63 being in contact with split ring 30.

Figure 3:
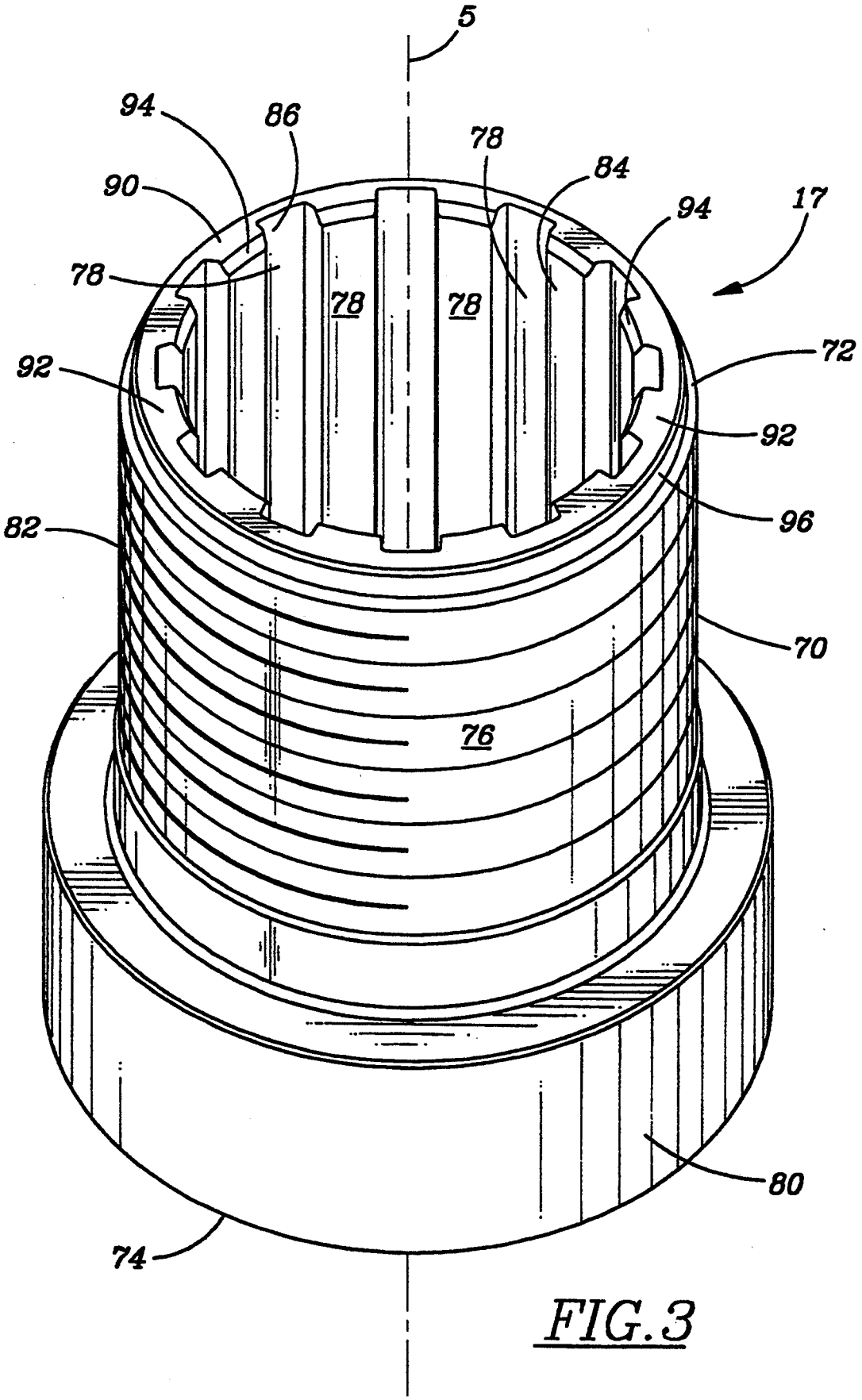
FIG. 3 is an isometric view, with parts removed, of the chuck of the invention.

Now referring to FIGS. 2–5, the apparatus of the invention is shown. As shown in FIG. 3, chuck 17 comprises a hollow, cylindrical body 70 encircling longitudinal axis 5. Body 70 has a longitudinal length extending between a top end 72 and a bottom end 74, with a radial thickness extending between an external surface 76 and an internal surface 78. External surface 78 forms a base 80 at bottom end 74 and a threaded shank 82 at top end 72. Internal surface 78 forms a plurality of alternating splines 84 and grooves 86. Splines 84 are parallel and extend longitudinally to top end 72 and end adjacent, but not all the way into, bottom end 74. These elements of the chuck 17 described hereinabove are conventional.

Chuck 17 includes means on the top end 72 for developing a longitudinal load thereon into a radially directed component of said load, in order to urge split ring 30 radially outwardly against internal surface 28 of casing 1. Such means comprises a shoulder 90 having a tapered face 92 thereon extending between internal surface 78 and external surface 76. Tapered face 92 tapers downwardly from internal surface 78 to external surface 76. Tapered face 92 intersects internal surface 78 at an inner edge 94 that is, preferably, chamfered for burr removal. Because of the presence of splines 84, the inner edge 94 is scalloped. Tapered face 92 intersects external surface 76 at an outer edge 96 that is annular, and, preferably, chamfered.

As shown in FIG. 2, in the assembled drill, tapered face 92 contacts a similarly tapered bottom face 100 on split ring 30. This contact develops any longitudinal load on chuck 17 into a radially directed component to urge split ring radially outwardly against casing. In its simplest version, the split ring 30 need not be tapered as initially installed, if it were of softer material than chuck 17, but would become so tapered upon wear. However, I prefer a tapered surface on both split ring 30 and chuck 17.

Figure 5:
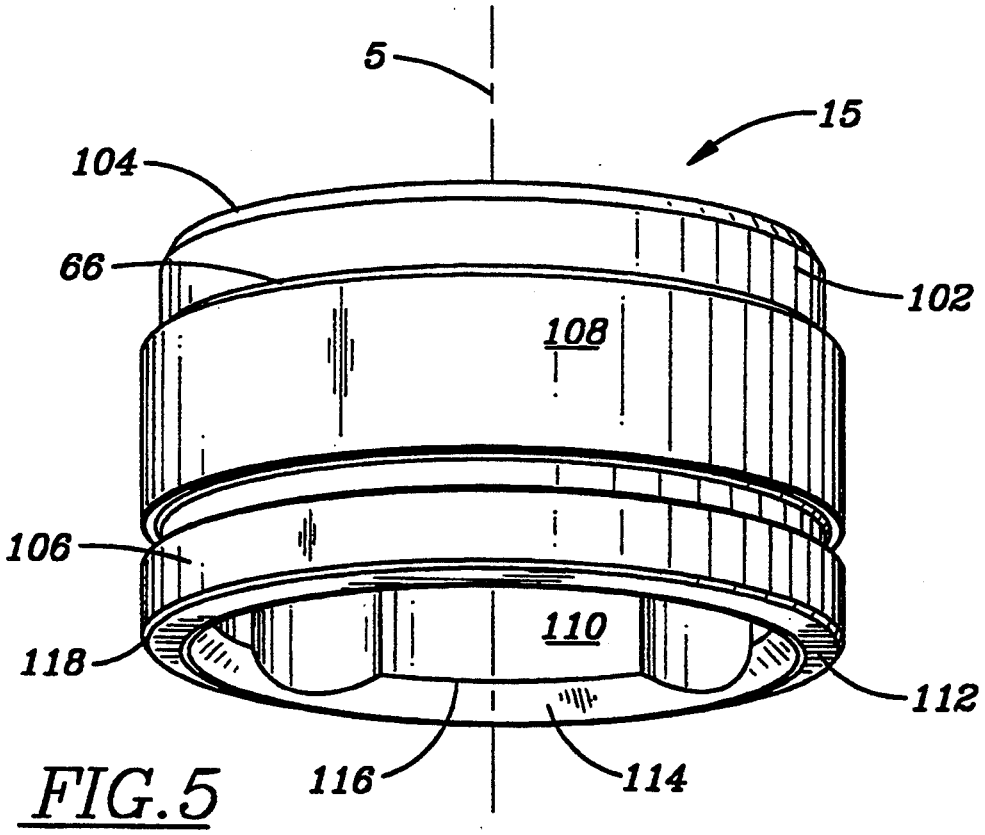
FIG. 5 is an isometric view, with parts removed, of the bit bearing of the invention.

As shown in FIG. 5, the bit bearing 15 comprises a hollow, cylindrical body 102 having a longitudinal length extending between a top end 104 and a bottom end 106 and a radial thickness extending between an external surface 108 and an internal surface 110. Bit bearing 15 includes means on the bottom end 106 for developing a longitudinal load thereon into a radially directed component of said load in order to urge split ring 30 radially outwardly against internal surface 28 of casing 1. Such means comprises a shoulder 112 having a tapered face 114 thereon extending between internal surface 110 and external surface 108. Tapered face 114 tapers downwardly from external surface 108 to internal surface 110. Tapered face 114 intersects internal surface 110 at a scalloped inner edge 116 that encircles axis 5. Tapered face 114 intersects external surface at an annular outer edge 118. Both edges 116 and 118 are, preferably, chamfered. At top end 104, is located shoulder 66 for elastic member 44, as described hereinabove.

As shown in FIG. 2, in the assembled drill, tapered face 114 contacts a similarly tapered top face 118 on split ring 30. This contact develops any longitudinal load on bit bearing 15 into a radially directed component to urge split ring 30 radially outwardly against casing 1. In its simplest version, the split ring 30 need not be tapered as initially installed, if it were of softer material than chuck 17,but would become so tapered upon wear. However, I prefer a matching tapered surface on both split ring 30 and bit bearing 15.

Figure 4:
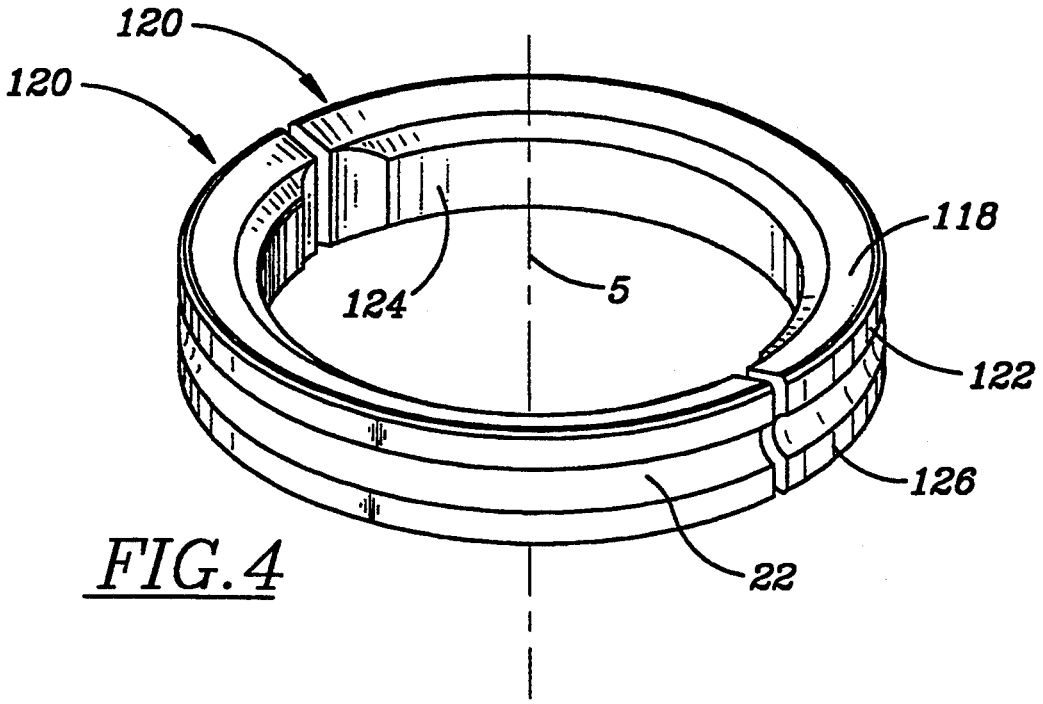
FIG. 4 is an isometric view of the split ring of the invention.

FIG. 4 shows the preferred split ring of the invention. Split ring 30 comprises a pair of substantially identical ring halves 120. A description of one will suffice for both. Ring half 120 has an external surface 122 and an internal surface 124 and approximates a semi-circle formed by a longitudinally extending body portion 126 terminating at a tapered top surface 118 and a tapered bottom surface 100 (FIG. 2). The separate ring halves are produced from one hollow, cylindrical body which is first tapered at the top and bottom, and thereafter diametrically cut into two pieces. The kerf of the cut represents the amount of arc distance that will be present between ring halves, as assembled in a drill. This distance is schematically shown in the encircled portions A in FIGS. 1 and 2. It will be appreciated that, because of the orientation of the top tapered surface 118 and the bottom tapered surface 100, the preferred form of split ring 30 is reversible. That is, it can be inserted into the assembled drill without regard to which tapered surface is top or bottom.

In order to be sure that split ring 30 actually slides radially outwardly, the taper angle of all tapered surfaces must be selected such that any longitudinal loading force normally present will result in a sufficient radial force on the split ring 30 to overcome frictional resistance to sliding of the split ring 30. Such normally present longitudinal load is created by elastic member 44 and the weight of internal parts acting upon the tapered surfaces. This requirement defines a critical minimum angle of all tapered surfaces.

However, there is a condition that unexpectedly limits the angle of taper of all tapered surfaces to a second, critical maximum limit. If this maximum taper angle is not properly preselected, it is possible to damage the casing 3. That condition arises as follows: occasionally during drilling, the bit 13 breaks through a hard strata and enters a softer strata. This results in the piston 3 driving the bit 13 rapidly forward to the point that bit shoulder 63 impacts the split ring 30. This condition is shown in FIGS. 1 and 2 to the right of axis 5. This impact creates a full piston impact load on the tapered surfaces. This full longitudinal impact load develops such a large radially directed component, due to the tapered surfaces, that the stresses transmitted to the casing by the split ring 30 can exceed the elastic limit of the casing 1.

Typically, such full impact load stresses are maximum in the casing at the portion of the casing that is not being contacted by the external surface 122 of each split ring half 120. That location is between split ring halves 120 (shown in circled portion A of FIGS. 1 and 2).

For down-hole drills typically in use, therefore, it is necessary to select both the minimum taper angle (to overcome friction) and the maximum taper angle (to avoid casing damage during full impact loading).

Figure 6:
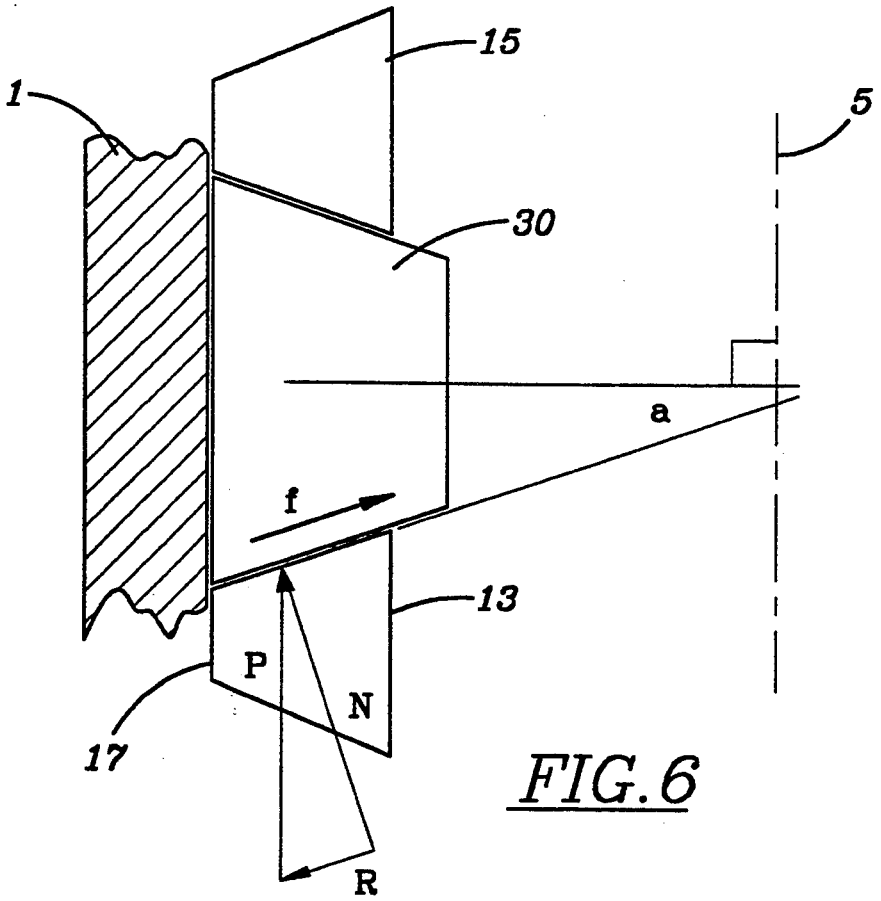
FIG. 6 is a schematic view showing the minimum angle of taper permitted by the invention.

FIG. 6 shows schematically how the minimum critical taper angle is determined. The minimum taper angle will be such that the radial component of force developed by the angled contact can overcome the sliding friction along the tapered surfaces in contact. The angle at which sliding can take place is defined as the angle whose tangent is the coefficient of friction. For slippage (radial movement) to occur, the following conditions must pertain:

FOR SLIPPAGE (RADIAL MOVEMENT) TO OCCUR:

coefficient of friction for oiled hardened steel: $\mu=0.1$ longitudinal load resulting from weight of parts and preloading elastic member=P component of longitudinal load P along slippage plane: R>f and R=P sin (a)

Component of longitudinal load P normal to slippage plane: N=P cos (a)

frictional resistance along slippage plane: $f=\mu N=\mu P$ cos (a) therefore:

P sin (a)>$\mu$P cos (a) or tan (a)>$\mu$ and a>5.7 degrees

As shown in FIG. 6, angle a must be at least 5.7 degrees in order for sliding to occur in the presence of normal longitudinal force. This defines the lower limit of taper angle a, as measured from a perpendicular to axis 5.

Figure 7:
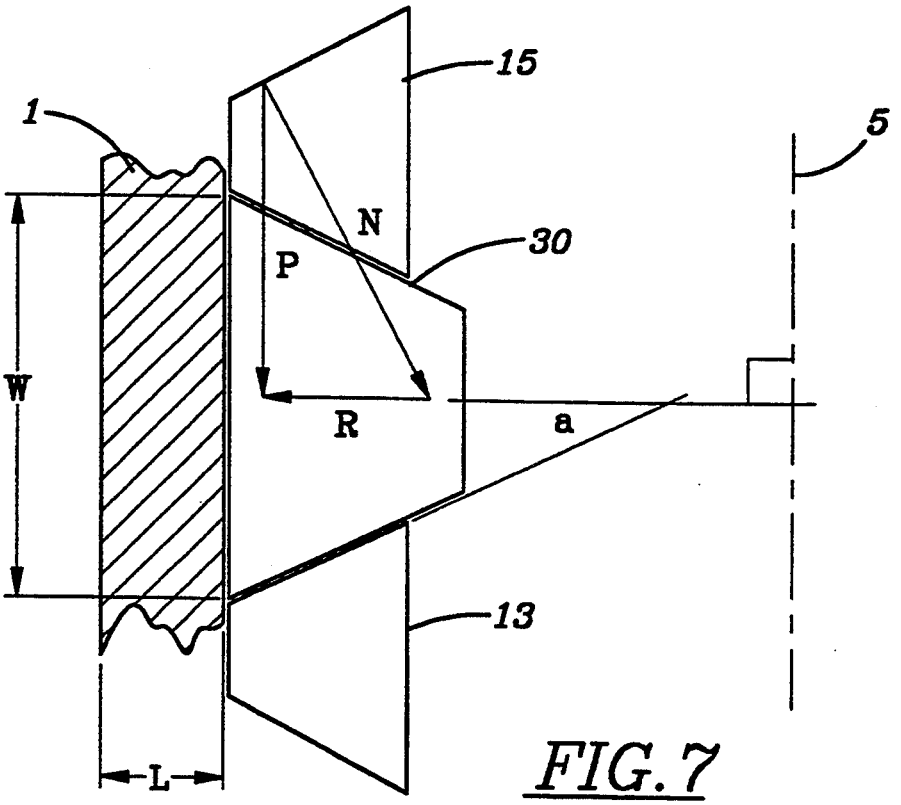
FIG. 7 is a schematic view showing the maximum angle of taper permitted by the invention.

FIG. 7 shows schematically how the maximum critical taper angle is determined. I have determined that for a typical 4-inch diameter down-hole drill, the full impact piston load is about 100,000 pounds. Coincidentally, the maximum stress permitted by the typical casing in such a drill is 100,000 psi. As stated above, typically full impact load stresses are maximum in the casing at the portion of the casing that is not being contacted by the external surface 122 of each split ring half 120, that is between split ring halves 120. Therefore, in such a drill wherein the full impact load is placed upon the split rings, in order to avoid damage to the casing, one should have a maximum taper angle as determined by the following:

REACTION STRESS/LOADS WITH CASING:

Casing stress<100,000 psi

Axial loading due to impact for four inch DHD: P=100,000 lbs.

casing thickness for four inch DHD: t=0.31 in.

longitudinal body length for split rings in four inch DHD: w=0.75 in.

radial component of the impact load developed due to taper angle a: R=P tan (a)

component of load P normal to slippage plane: N stress must therefore be less than load/area or P tan-(a)/(2 t w)

therefore: tan (a)<0.46 and a<25 degrees

As is well known, the casing cross-sectional area being stressed is determined by the casing thickness(t) times longitudinal length of casing being supported by ring body length w. Since there are two areas of casing not being supported by the split ring 30 the total cross-sectional area being stressed must be doubled. As shown in FIG. 7 the maximum taper angle a must not exceed 25 degrees, as measured from a perpendicular to axis 5.

Having described the invention, what is claimed is:

1. A chuck for a percussive, down-hole drill, for positioning a split retaining ring against an internal surface of a hollow, cylindrical drill casing, said chuck comprising:

(a) a hollow, cylindrical body encircling a longitudinal axis, said body having a longitudinal length extending between a top end and a bottom end, a radial thickness extending between an external surface and an internal surface;

(b) said external surface forming a base at said bottom end and a threaded shank at said top end;

(c) said internal surface forming a plurality of parallel, longitudinally extending splines, said splines extending to said top end and ending adjacent said bottom end; and (d) means on said top end for developing a longitudinal load exerted thereon into a radial load that exceeds a preselected minimum radial load but does not exceed a preselected maximum radial load.

2. The chuck of claim 1 wherein said means on said top end comprises:

(a) a shoulder thereon having a tapered face extending between said internal surface and said external surface, said face tapering downwardly from said internal surface to said external surface, said tapered face subtending an angle, measured from a perpendicular to said longitudinal axis, between 5.7 degrees and 25 degrees.

3. An apparatus for a percussive, down-hole drill, for positioning a split retaining ring against an internal surface of a hollow, cylindrical drill casing comprising:

(a) a hollow, cylindrical bit bearing for supporting and guiding a drill bit;

(c) an annular split retaining ring having a top surface in contact with a bottom end of said bit bearing;

(d) a hollow, cylindrical chuck having a top end in contact with a bottom surface on said split retaining ring;

(e) means on said top end of said chuck for developing a portion of any longitudinal load exerted thereon by said split retaining ring into a preselected maximum amount of radial load against said split retaining ring, to urge said split retaining ring radially outwardly against the drill casing, without exceeding an elastic limit of the casing.

4. The apparatus of claim 3 further including means on said bottom end of said bit bearing for developing a portion of any longitudinal load exerted thereon by said split retaining ring into a preselected maximum amount of radial load against said split retaining ring, to urge said split retaining ring radially outwardly against the drill casing, without exceeding an elastic limit of the casing.

5. The apparatus of claim 4 wherein said means on said top end of said chuck comprises:

(a) a shoulder thereon having a tapered face extending between an internal chuck surface and an external chuck surface, said face tapering downwardly from said internal surface to said external surface, said tapered face subtending an angle, measured from a perpendicular to said longitudinal axis, between 5.7 degrees and 25 degrees.

6. The apparatus of claim 5 wherein said means on said bottom end of said bit bearing comprises:

(a) a shoulder thereon having a tapered face extending between an internal bearing surface and an external bearing surface, said face tapering downwardly from said external surface to said internal surface, said tapered face subtending an angle, measured from a perpendicular to said longitudinal axis, between 5.7 degrees and 25 degrees.

7. The apparatus of claim 6 wherein said split retaining ring comprises:

(a) a pair of ring halves, each ring half having an external surface and an internal surface, each ring half approximating a semi-circle formed by a longitudinally extending body portion terminating at a tapered top surface and a tapered bottom surface;

(b) said tapered top surface tapered at an angle subtending an angle, measured from a perpendicular to said longitudinal axis, between 5.7 degrees and 25 degrees, said angle being equal to, and oriented the same as, said angle of said bit bearing bottom; and (c) said tapered bottom surface tapered at an angle subtending an angle, measured from a perpendicular to said longitudinal axis, between 5.7 degrees and 25 degrees, said angle being equal to, and oriented the same as, said angle of said chuck top end.

8. A bit bearing for a percussive, down-hole drill, for positioning a split retaining ring against an internal surface of a hollow, cylindrical drill casing, said bit bearing comprising:

(a) a hollow, cylindrical body encircling a longitudinal axis, said body having a longitudinal length extending between a top end and a bottom end, a radial thickness extending between an external surface and an internal surface; and (b) means on said bottom end for developing a longitudinal load exerted thereon into a radial load that exceeds a preselected minimum load but does not exceed a preselected maximum radial load.

9. In a down-hole percussion impact drill having a hollow, cylindrical casing; a drill bit extending out a bottom end of the casing; a reciprocable piston in sliding contact with an internal surface of the casing and in cyclical percussive contact with the bit; a bit bearing in the casing for supporting and guiding the bit; an annular split ring in the casing for retaining the bit bearing and the bit in the casing; and a chuck for retaining the split ring and bit in the casing, the improvement comprising the chuck including:

(a) a hollow, cylindrical body encircling a longitudinal axis, said body having a longitudinal length extending between a top end and a bottom end, a radial thickness extending between an external surface and an internal surface;

(b) said external surface forming a base at said bottom end and a threaded shank at said top end;

(c) said internal surface forming a plurality of parallel, longitudinally extending splines, said splines extending to said top end and ending adjacent said bottom end;

(d) said top end defining a tapered shoulder positioned annularly around said longitudinal axis, said shoulder having a tapered face extending between said internal surface and said external surface, said face tapering downwardly and outwardly from said internal surface to said external surface;

(e) said tapered face subtending an angle, measured from a perpendicular to said longitudinal axis, between 5.7 degrees and 25 degrees, whereby said tapered shoulder develops longitudinal downward force on the split ring into a predetermined maximum amount of radial force, to urge the split ring radially outwardly against an internal casing surface without stressing said casing beyond an elastic limit.

10. A reversible split ring for positioning between a bit bearing bottom and a chuck top end in a down-hole percussive impact drill comprising:

(a) a pair of ring halves, spaced around a longitudinal axis extending therethrough, each ring half having an external surface and an internal surface, each ring half approximating a semi-circle formed by a longitudinally extending body portion terminating at a tapered top surface and a tapered bottom surface;

(b) said tapered top surface tapering downwardly from said external surface to said internal surface an angle subtending an angle, measured from a perpendicular to said longitudinal axis, between 5.7 degrees and 25 degrees; and (c) said tapered bottom surface tapering upwardly from said internal surface to said external surface at an angle subtending an angle, measured from a perpendicular to said longitudinal axis, between 5.7 degrees and 25 degrees.

* * * * *